US009781524B2

(12) United States Patent
Olsen et al.

(10) Patent No.: US 9,781,524 B2
(45) Date of Patent: Oct. 3, 2017

(54) COMMUNICATION SYSTEM

(71) Applicant: OTICON A/S, Smørum (DK)

(72) Inventors: Thor Højlund Olsen, Smørum (DK); Maria Thorborg Hansen, Copenhagen N (DK); Camilla Christensen, Copenhagen N (DK); Emanuela Voorwinden, Delft (NL); Jesper Vermehren Jensen, Copenhagen N (DK); Astrid Birch, Frederiksberg (DK)

(73) Assignee: OTICON A/S, Smørum (DK)

( * ) Notice: Subject to any disclaimer, the term of this patent is extended or adjusted under 35 U.S.C. 154(b) by 108 days.

(21) Appl. No.: 14/546,448

(22) Filed: Nov. 18, 2014

(65) Prior Publication Data

US 2015/0139459 A1 May 21, 2015

(30) Foreign Application Priority Data

Nov. 19, 2013 (EP) ..... 13193409

(51) Int. Cl.
*H04R 25/00* (2006.01)
*H04R 1/10* (2006.01)

(52) U.S. Cl.
CPC ..... *H04R 25/554* (2013.01); *H04R 1/1091* (2013.01); *H04R 25/552* (2013.01);
(Continued)

(58) Field of Classification Search
CPC .. H04R 25/552; H04R 25/554; H04R 25/556; H04R 25/558; H04R 25/606;
(Continued)

(56) References Cited

U.S. PATENT DOCUMENTS 5,824,022 A * 10/1998 Zilberman ..... A61N 1/36032 128/903
6,035,050 A * 3/2000 Weinfurtner ..... H04R 25/507 381/313

(Continued)

FOREIGN PATENT DOCUMENTS

EP 2 605 546 A1 6/2013

*Primary Examiner* — Huyen D Le
(74) *Attorney, Agent, or Firm* — Birch, Stewart, Kolasch & Birch, LLP

(57) ABSTRACT

The present invention regards a communication system (10; 10*a*; 10*b*; 10*c*) comprising at least one communication device (36, 36*a*, 36*b*, 36*c*) configured to connect to other communication devices (36, 36*a*, 36*b*, 36*c*) via an audio and data link (52). The communication device (36, 36*a*, 36*b*, 36*c*) comprises at least a receiver unit (40), an output transducer (32), a microphone (22, 22'), a transmitter unit (42), and a control unit (38). The receiver unit (40) is adapted to receive audio signals and data signals via the audio and data link (52). The output transducer (32) is adapted to stimulate the hearing of the user (12, 20, 30) according to the audio signals received via the audio and data link (52). The microphone (22, 22') is adapted to receive input sound (44) and generate an audio signal from the received input sound (44). The transmitter unit (42) is adapted to transmit audio signals and data signals via the audio and data link (52). The control unit (38) is connected to the receiver unit (40), to the output transducer (32), to the microphone (22, 22'), and to the transmitter unit (42). The control unit (38) is adapted to control the signal transmission between the receiver unit (40), the output transducer (32), the microphone (22, 22'), and the transmitter unit (42). The control unit (38) is further adapted to generate a data signal corresponding to the communication device (36, 36*a*, 36*b*, 36*c*) for identifying the communication device (36, 36*a*, 36*b*, 36*c*). And the control unit (38) comprises a processor
(Continued)

(46) which is adapted to process audio signals and data signals. The communication device (36, 36*a,* 36*b,* 36*c*) is connectable to an attachable digital receiver (26) via the audio and data link (52). The attachable digital receiver (26) has a shape that matches a shape of a hearing aid (28) in order to be attached to the hearing aid (28). The communication devices (36, 36*a,* 36*b,* 36*c*) of the communication system (10; 10*a;* 10*b;* 10*c*) can be Smartphones.

12 Claims, 4 Drawing Sheets

(52) U.S. Cl.
CPC ..... *H04R 25/558* (2013.01); *H04R 25/556* (2013.01); *H04R 2225/55* (2013.01); *H04R 2420/07* (2013.01)

(58) Field of Classification Search
CPC ..... H04R 2225/021; H04R 2225/63; H04R 2225/67; H04R 2420/07; H04R 1/1091; H04R 25/43; H04R 2225/55; H04R 2225/61; A61N 1/36032
USPC ..... 381/23.1, 312, 314, 315, 326, 328, 330, 381/331; 607/55, 56, 57; 455/41.2, 501, 455/509, 550.1
See application file for complete search history.

(56) References Cited

U.S. PATENT DOCUMENTS

| | | | | |
|---|---|---|---|---|
| 6,775,389 | B2 * | 8/2004 | Harrison | A61N 1/36032 381/328 |
| 2007/0230727 | A1 | 10/2007 | Sanguino et al. | |
| 2010/0142740 | A1 | 6/2010 | Roerup | |

* cited by examiner

COMMUNICATION SYSTEM

The invention regards a communication system comprising at least one communication device connectable to a digital receiver attachable to or forming part of (being integrated with) a hearing aid or comprising a hearing aid and configured to connect to other communication devices via an audio and data link. Communication systems are generally used for the effective communication between at least two users. A communication system can, for example, be configured for communication between distant users or to enhance a communication between users having problems to understand each other, e.g., because of language problems, sound level problems and/or hearing problems. Especially hearing impaired students can benefit from communication systems.

Hearing impaired students want to blend in with the rest of a class and do not want to draw attention to their hearing difficulties. At the same time it is essential for the hearing impaired students to be able to follow the teaching with a limit of hassle and a good signal-to-noise ratio (SNR).

In the embodiment of an assistive learning system, a communication system is used for hearing impaired children, adolescents and adults to increase their chances of effective learning and to bridge the distance between teacher and hearing impaired student. Assistive learning systems commonly comprise a microphone and a transmitter for the teacher and a hearing device with a receiving unit for the hearing impaired student. The microphone records speech of the teacher and the transmitter transmits the speech of the teacher with frequency modulation (FM) technology to the receiving unit, e.g., a so called "shoe" (FM-shoe) attached to the hearing device of the hearing impaired student. Other students in a class can have a shared microphone or an individual microphone for each of the students. The microphones of the other students are configured to record speech of the other students and transmit it to the receiving unit of the hearing impaired student via the transmitter of the teacher.

WO 2008/074350 A1 presents a communication system, comprising at least one receiver unit, a wireless audio link, a stimulating means, a plurality of transmission units, a control unit and optionally an external command unit. The receiver unit is to be worn by a user and adapted to receive audio signals via the wireless audio link. The stimulating means for stimulating the user's hearing is connected to the receiver unit or comprised therein. Each of the plurality of transmission units is adapted to be worn by a user and comprises a microphone arrangement, an audio signal transmission portion, an assistive digital link transceiver portion, and a control unit. The microphone arrangement captures audio signals from the respective user's voice. The audio signal transmission portion establishes the wireless audio link to the receiver unit in order to transmit the captured audio signals. The assistive digital link transceiver portion establishes a bidirectional assistive digital link to other transmission units. The control unit controls the audio signal transmission of the transmission unit according to data exchanged with the control unit of the other transmission unit.

It is an object of the invention to provide an improved communication system.

This object is achieved by a communication system comprising at least one communication device configured to connect to other communication devices via an audio and data link. The communication device comprises at least a receiver unit, an output transducer, a microphone, a transmitter unit, and a control unit. The control unit is connected to the receiver unit, the output transducer, the microphone, and the transmitter unit.

The receiver unit is adapted to receive audio signals and data signals via the audio and data link. The output transducer is adapted to stimulate the hearing of the user according to the audio signals received via the audio and data link. The microphone is adapted to receive input sound and generate an audio signal from the received input sound. The transmitter unit is adapted to transmit audio signals and data signals via the audio and data link. The control unit is adapted to control the signal transmission between the receiver unit, the output transducer, the microphone, and the transmitter unit. The control unit is further adapted to generate a data signal corresponding to the communication device for identifying the communication device. And the control unit comprises a processor which is adapted to process audio signals and data signals. The communication device is connectable to an attachable digital receiver via the audio and data link. In an embodiment, the digital receiver is attachable to a hearing aid and has a shape that matches a shape of the hearing aid in order to be attached to the hearing aid. In an embodiment, the digital receiver is not adapted to fit the shape of the hearing aid. In an alternative embodiment, the digital receiver is integrated with the hearing aid.

One aspect of the invention is that the communication blends into the physical environment and does not make hearing impaired users feel exposed. Another aspect of the invention is that the communication system is easily accessible, as the system looks like common technology, therefore users do not need special skills to use the communication system. A further aspect is that digital signals can have a good signal-to-noise ratio (SNR) and the connection can be more stable. The communication system can be cheaper as integration of already existing devices is possible. The communication system can form small, local closed networks with several devices and device types. The communication system can give a feedback on the system status and on the communication devices forming the communication system. Another aspect of the invention is that fewer electronic devices are needed and a communication device of the communication system presents an "all-in-one"-solution. The feedback will also make the hearing impaired students/pupils feel less exposed, as they do not have to draw attention to their hearing loss themselves by pointing out (loud) if something is wrong with the connection.

In as preferred embodiment of the system the output transducer of at least one of the communication devices is an output transducer of a hearing aid. The output transducer can for example be a loudspeaker, electrodes of a cochlear implant, or another hearing aid output transducer which enables the stimulation of the hearing of a hearing impaired user (e.g. a vibrator of a bone anchored hearing device).

In one embodiment at least one hearing aid, which is adapted to be worn by a user, is connected to the communication system via the audio and data link. Preferably the hearing aid comprises at least a receiver unit adapted to receive audio signals via the audio and data link and an output transducer adapted to stimulate the hearing of a user according to the audio signals received.

In a preferred embodiment the (e.g. attachable) digital receiver is connected to the communication system via the audio and data link when in use. Preferably the (attachable) digital receiver comprises a receiver unit to receive audio signals via the audio and data link and is adapted to be attached to or is integrated with a hearing aid. Most preferably the attachable digital receiver has a shape that matches the shape of the hearing aid in order to be attached to the hearing aid. The hearing aid is preferably adapted to be worn by a user and comprises at least an output transducer which is adapted to stimulate the hearing of a user according to the audio signals received by the receiver unit of the attachable digital receiver.

In another preferred embodiment each device, e.g., communication device, attachable digital receiver, hearing aid (or hearing aid comprising a digital receiver), Smartphone, laptop, tablet, or other mobile device of the communication system is mobile. A "mobile" device of the communication system is to be understood in the context of this text as a device with a weight less than 1000 g, more preferably less than 500 g, most preferably less than 300 g. A mobile device preferably has a volume of less than 0.01 $m^3$, more preferably less than 0.001 $m^3$, most preferably less than 0.0001 $m^3$. As in a preferred embodiment each individual device of the communication system is mobile, also the communication system is mobile. This has the advantage, that the communication system can be used independent of a certain location. Also only parts of the communication system can be mobile and other parts can be stationary, e.g., a stationary personal computer connected to mobile Smartphones, Tablets, Laptops or the like.

In one embodiment, at least one of the communication devices of the communication system is a master device and all other communication devices are slave devices. Preferably, the master device is configured to receive audio signals and data signals from the slave devices and transmit audio signals and data signals to the slave devices. The slave devices can be configured to receive audio signals and data signals only from the master device forming a network with the master device as a network hub. Alternatively, the slave devices can be configured to receive audio signals and data signals from other slave devices forming a peer-to-peer network.

In a preferred embodiment of the communication system, the communication device comprises a memory, which is adapted to store audio signals and/or data signals. Preferably a whole class or lecture can be stored for later use, e.g., for preparation of exams, for analysis of student participation, e.g., by an automated voice recognition procedure that determines the amount of participation or for other uses.

In a preferred embodiment, at least one of the communication devices of the communication system is a Smartphone, which preferably comprises a cellular phone part comprising a microphone, an output transducer, e.g., a loudspeaker, and a wireless interface to the public switched telephone network (PSTN) and a personal computer part comprising a processor, a memory, an operating system (OS), a user interface, e.g., a keyboard and a display, such as a keyboard integrated in a touch sensitive display, and a wireless data interface, preferably including a web-browser allowing a user to download application programs (apps), which can be executed on the processor and which implement functional features, e.g., displaying information from various sensors of the Smartphone, e.g., camera, scanner, GPS, microphone or other sensors and/or external sensors that provide special features. Preferably, the Smartphone is configured to run a teacher-student-Smartphone-app-system to form a communication system with other Smartphones.

In one embodiment, at least one communication device is connected to an external microphone which is adapted to be worn by a user. Preferably the external microphone is automatically identified by the control unit of a corresponding communication device. The external microphone can be connected by a cable or wirelessly, e.g., via the audio and data link. The external microphone can for example be worn by a teacher or lecturer to increase the signal-to-noise-ratio (SNR) of a lecture, as the teacher or lecturer is the user that generally has the highest participation in the communication over the communication device.

In a preferred embodiment the communication device comprises a voice detector adapted to determine if an audio signal comprises a voice signal (e.g. a user's own voice or a voice in general). The voice detector is preferably connected to the control unit which can be adapted to automatically transmit the audio signal, when a voice signal (e.g. a user's own voice or a voice in general) is detected in the audio signal by the voice detector. In one embodiment the control unit is configured to reject the transmission of the audio signal, if no voice signal is detected in the audio signal by the voice detector.

In one embodiment of the communication system, the audio and data link is a digital link. The digital link preferably forms a wireless network between the communication devices of the communication system. In an embodiment, the digital link is a wireless link based on radiated fields. In an embodiment, the digital link is a wireless link operating in a non-licensed frequency range, e.g. ISM (ISM=Industrial, Scientific and Medical, e.g. around 865 MHz or 2.4 GHz). In an embodiment, the digital link is a wireless link based on Blue-tooth or other proprietary or standardized, relatively low power (and correspondingly short range, e.g. less than 100 m) technologies (e.g. Bluetooth Low Energy, DECT, Wi-Fi (IEEE 802.11), ZigBee, etc.). Alternatively or additionally a digital link can also be wire based between a part of the communication system or all of the communication devices and/or devices of the communication system.

In a preferred embodiment of the communication system, at least one of the communication devices is adapted to connect to other media that did not initially form part of the communication system, e.g., a Smartphone, a television, a personal computer, a tablet pc, a digital frame, an audio system, a radio, a Smartboard or similar devices comprising a digital transceiver unit. This allows to integrate different devices in the communication system and increases the accessibility to the communication system, as no specific standard communication device model is required to connect to and participate within the communication system.

Preferably, "Smartphones" are used as communication devices in a communication system. Additionally or alternatively, communication devices are configured to be connectable to Smartphones.

In an embodiment, a digital receiver (or transceiver) is integrated with a hearing aid to allow the hearing aid to communicate With the at least one communication device via an audio and data link and to receive digital audio signals and digital data signals via the audio and data link wirelessly. In an embodiment, the at least one communication device comprises (or is integrated with) a hearing aid.

The invention further resides in an attachable digital receiver configured to connect a communication device and a hearing aid. The attachable digital receiver comprises a receiver unit and a transmitter unit. The receiver unit is configured to connect to at least one communication device via an audio and data link and to receive digital audio signals and digital data signals via the audio and data link wirelessly. In an embodiment, the attachable digital receiver has a shape that matches a shape of the hearing aid in order to be attached to the hearing aid. The transmitter unit is configured to connect to the hearing aid and to transmit digital audio signals and digital data signals to the hearing aid. The data transmission from and to the attachable digital receiver is digital in contrast to an analog transmission. Digital here means discrete and discontinuous values for the encoding of the digital audio signals and digital data signals, which can be decoded by a digital-to-analog converter (D/A). Analog signals can be encoded by an analog-to-digital converter (A/D). Communication devices, hearing aids and the attachable digital receiver can optionally comprise D/A and A/D converters to convert between digital and analog signals. The transmission of the audio signals and data signals is wireless via the audio and data link. The transmission from the attachable digital receiver to the hearing aid can be wireless or wired, e.g., using a connector between the hearing aid and the digital attachable receiver.

A preferred method for operating a communication system comprises a step of establishing an audio and data link between communication devices. Preferably, the method comprises a step of receiving audio and data signals from communication devices. The method can further comprise a step of saving data from communication devices. Preferably, the method comprises a step of determining which communication devices are connected with the communication system. The method can further comprise a step of determining which communication device has priority. The method can further comprise a step of giving priority to the audio signal of the communication device, which has priority. Preferably, the method also comprises a step of transmitting the audio signal to all communication devices or transmitting the audio signal with priority to all communication devices, which do not have priority.

In one embodiment, at least one communication device of the communication system comprises a vibration unit. Preferably, also the hearing aid and/or the attachable digital receiver connected to the hearing aid comprise a vibration unit. The vibration unit is preferably configured to vibrate if the connection to the communication system is low or lost. Alternatively or additionally the communication device can also comprise a light emitting diode (LED) or other visual means for indicating a low connection or lost connection. The visual indication for low connection or lost connection can for example be performed by blinking of the LED or light intensity of the other visual means. The connection status is preferably correlated to the intensity of the vibrational indication and/or visual indication of the connection.

In another embodiment the communication system is connected to a "Smartboard", which is to be understood as a virtual board that allows access via a wireless link (e.g. Wi-Fi) and a touch screen display. Audio signals and/or data signals can be transmitted to the "Smartboard", which can display the audio signals in text form or output them as sound by a loudspeaker integrated in the Smartboard. The Smartboard can preferably further be accessed by the touch screen display to add content to the Smartboard. Preferably, the data on the Smartboard is transmitted to the communication devices of the communication system and can be stored by the communication devices for later use.

Preferably, the microphones of the communication devices and the external microphone or microphones turn on and off automatically. Preferably, the microphones turn on when a sound level threshold is reached and/or a voice is detected by the voice detector of the communication device. The communication device can comprise a means to mute and/or activate the microphone independently of the automatic on and off switching of the microphone. Preferably, the sound transmission of the communication device can be turned off or on. The receiving of sound and/or outputting of sound by the communication device and/or the hearing aid can also be turned on or off.

The communication system formed by the communication devices can be an open or a locked, respectively closed, network. An open network allows access for every communication device that wants to join the communication system. A locked or closed network is a network, which is limited to a certain number of communication devices, certain communication devices or communication devices transmitting a code required to join the communication system (e.g. as part of an authorization process, e.g. pairing).

In one embodiment, the master device is configured to control the microphone on and off status of the other communication devices. The master device can further be configured to control the signal transmission to and from the slave devices, e.g., control which audio signals and data signals are transmitted and therefore what a user of a slave device hears. Preferably, in this embodiment the master device is a teacher or lecturers communication device.

In a preferred embodiment, each communication device is configured to control from which communication device of the communication system audio signals and/or data signals can be received by the receiver unit of the communication device. Preferably, the communication device is configured to allow control of saving audio and/or data signals for all or selected communication devices. The communication device can also be configured to encrypt the audio signals and/or data signals. Only communication devices with the corresponding key can be able to decrypt the audio signals and/or data signals received from a respective communication device, which transmits encrypted audio signals and/or data signals.

In another preferred embodiment, the attachable digital receiver attached to a hearing aid or a receiver unit of a hearing aid can be configured to receive audio signals from a respective communication device or from a number of communication devices. Preferably, the attachable digital receiver or receiver unit can be configured to reject the output of audio signals from user selected communication devices to the hearing aid.

In an embodiment, the one or more communication devices comprises an operating system (OS) and are configured to run application programs (APPs) and provide a (possibly graphical) user interface allowing results to be presented and a user to interact with the communication system.

In another embodiment, the operating system or application (app) of the communication device can have different types of interfaces for a master user, slave user and/or a hearing aid user. The interface type preferably decides the status of the communication devices, which can be master device, slave device, or hearing aid user device. The master device can have a higher audio signal and data signal priority than all other users. A higher signal priority allows the signal to be transmitted and to be outputted instead of other signals with lower priority in case two or more signals are received at the same time frame. For example a teacher talking has a higher priority than a student. If signals with same priority collide, e.g., two students talking, the signal received earlier is preferably outputted. Alternatively, several speakers speaking at the same time are allowed to be presented simultaneously.

In one embodiment, the connection status of other communication devices to a respective communication device can be determined by the control unit of the respective communication device. Preferably, the control unit of the master device is configured to determine which communication devices and/or devices are connected to the communication system.

In one embodiment, the sound level of the audio signals can be controlled and adjusted through processing of the audio signals in the processor of the communication device. Preferably, the processing further allows to improve the signal-to-noise ratio (SNR), which improves the understanding of a voice in the audio signal in noisy situations.

In a preferred embodiment of the communication system, the app running on the communication devices allows to connect the communication device to the (attachable) digital receiver attached to or integrated with the hearing aid. The app can also be configured to run in a specialized version on the (attachable) digital receiver or the hearing aid.

Preferably, the communication system is based solely on digital technology. The communication system can also be based partly on digital technology and partly on analog technology.

In a preferred embodiment, the communication system is configured to connect to communication devices over the internet. This allows ill at home or distance learning students to take part in courses, classes or lectures using the app and connecting to the respective master device, e.g., of a teacher or network to follow the course. Preferably the communication system is connected to a camera or cameras adapted to record a video data signal. The video data signal can be transmitted to the communication devices to provide a visual feedback of the courses.

In one embodiment, the external microphone and/or the Smartphone microphones are connected to external loudspeakers. Alternatively or additionally the audio signals recorded by the microphones can be outputted by the loudspeakers of the Smartphones, which removes the necessity to supply external loudspeakers, e.g., in a lecture hall.

The communication system can also be used in universities for university courses, in parliaments for political discussions, or other situations where a large number of users need to communicate with each other.

In a preferred embodiment, the communication device, e.g. Smartphone, comprises an interface for text input, e.g., a touch screen display, a keyboard, or other text input interfaces or is connected to an interface for text input, bluetooth keyboard or the like. Text messages can be inserted in the text input of the communication device and transmitted as data signals to other communication devices and/or other devices. The text input can be displayed on a display of the communication device or it can be converted to an audio signal and outputted by an output transducer of the communication device, e.g., loud-speaker, headphone, or the like or the output transducer of a hearing aid, e.g., loudspeaker, vibrator of a bone anchored hearing device or electrodes of a cochlear implant hearing device, or the like connected to the communication device. The text input mode of the communication device is especially beneficial for mute and hearing impaired users, e.g., mute and hearing impaired students can participate in the courses more naturally through typing text messages. A "virtual voice" (e.g. an artificial voice of a speech synthesis system) of the mute and hearing impaired user is then outputted by the loudspeakers of the other communication devices and/or the hearing aids of hearing impaired users.

In one embodiment, a teacher is equipped with a microphone that is connected wirelessly to the communication device, e.g., Smartphone, which is configured to run a program, e.g., an app. Through the app the Smartphone can work as both a monitor and a transmitter. The Smartphone is preferably configured to transmit a digital signal to the hearing aid or hearing aids of a hearing impaired student or hearing impaired students. Every student can use their own Smartphone that works almost the same way as the Smartphone of the teacher with the only difference, that the Smartphone of the teacher is connected wirelessly to the microphone of the teacher. The students can use the microphone in the Smartphone to record sound, e.g., voice. All Smartphones of the students and teachers are wirelessly connected and form the communication system, e.g., a network of Smartphones. The network can also include other types of communication devices or devices, e.g., tablets, laptops, personal computers, or the like. Preferably every user of the app is registered personally, which enables each user to identify other users virtually on the network formed by the wirelessly connected Smartphones.

Preferably the teacher starts the application on the Smartphone before class. Subsequently, the students, including the hearing impaired students, can connect to the teacher's personal network when they arrive in class. The Smartphone of the teacher preferably determines the connection status of each student through the app. Furthermore, the teacher can see and save a list of the connected students/pupils and use it as a digital protocol.

In one embodiment the communication device, e.g., a Smartphone or another mobile device acts as a remote control and id configure to allow to connect the hearing aid to other media or communication devices.

In the present context, a 'hearing aid' or 'hearing assistance device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing aids, an amplifier may constitute the signal processing circuit. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing aid system' refers to a system comprising one or two hearing aids, and a 'binaural listening system' refers to a system comprising one or two hearing aids and being adapted to cooperatively provide audible signals to both of the user's ears. Hearing aid systems or binaural hearing aid systems may further comprise 'auxiliary devices', which communicate with the hearing aids and affect and/or benefit from the function of the hearing aids. Auxiliary devices may be e.g. remote controls, audio gateway devices, mobile phones, public-address systems, car audio systems or music players. Hearing aids, listening systems or binaural listening systems may e.g. be used for compensating for a hearing-impaired person's loss of hearing capability, augmenting or protecting a normal-hearing person's hearing capability and/or conveying electronic audio signals to a person.

The present invention will be more fully understood from the following detailed description of embodiments thereof, taken together with the drawings in which.

Figure 1:
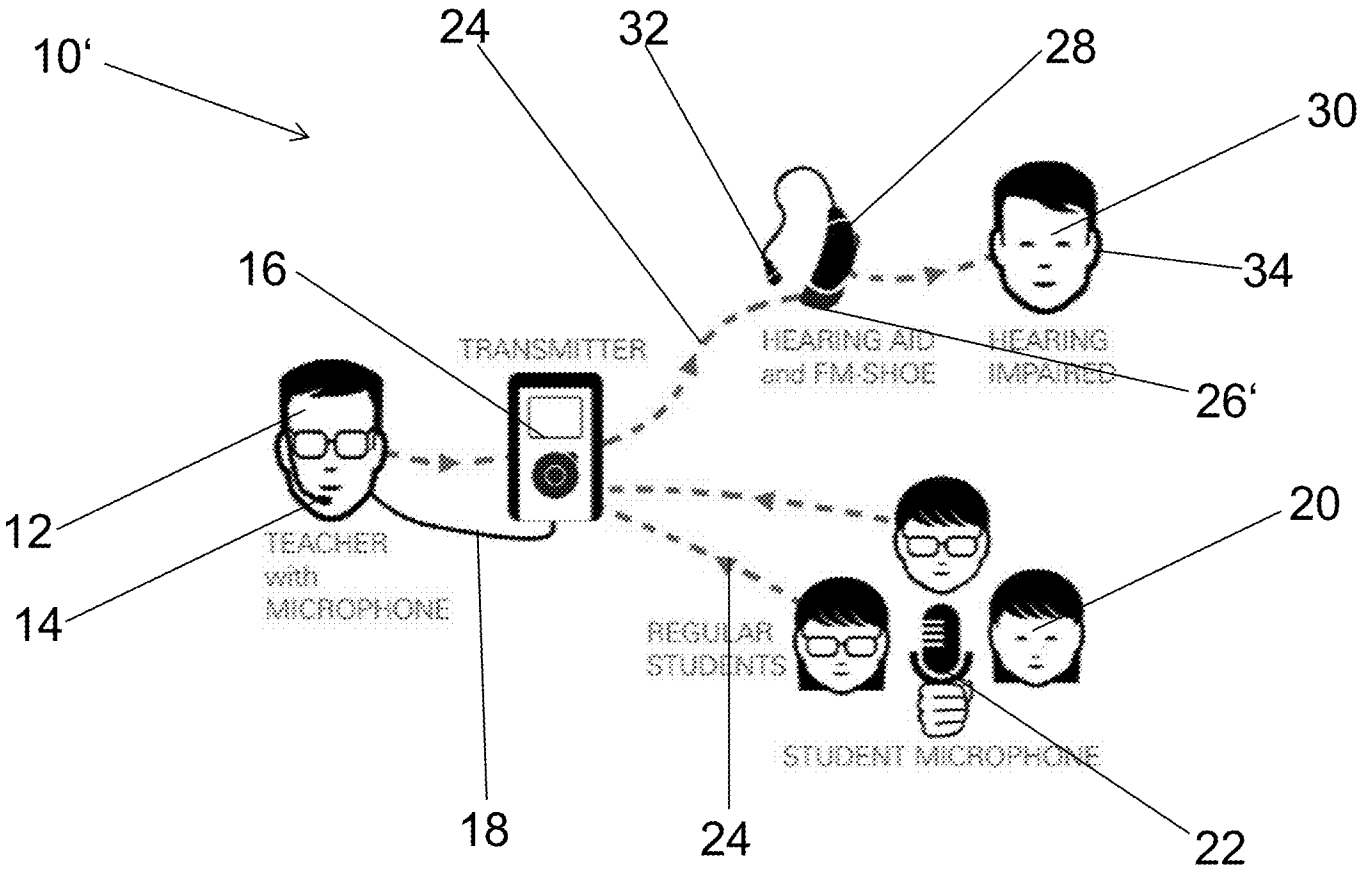
FIG. 1 shows a schematic illustration of a communication system of prior art.

FIG. 1 shows a prior art communication system 10', e.g., an assistive learning system. A teacher 12 wears a microphone 14 connected to a transmitter 16. The voice of the teacher is recorded by the microphone 14. The microphone 14 generates audio signals and transmits the audio signals via a cable 18 to the transmitter 16. The transmitter 16 is configured to receive audio signals from the teacher 12 from the microphone 14 and from students 20 from a student microphone 22. One or more student microphones 22 can be wirelessly connected to the transmitter 16 via an audio link 24.

The transmitter 16 transmits the audio signals of teacher 12 and students 20 to an FM-shoe 26' (Frequency Modulation-shoe) attached to a hearing aid 28 of a hearing impaired student 30 with FM-Technology. The FM-shoe 26' receives the audio signal and provides it to the hearing aid 28 where it is processed and transmitted to an output transducer 32, e.g., a loudspeaker, a vibrator or electrodes of a cochlear implant. The output transducer 32 stimulates the hearing in the ear 34 of the hearing impaired student 30. The hearing aid is adapted to be mounted at or in an ear 34 of the hearing impaired student 30.

Figure 2:
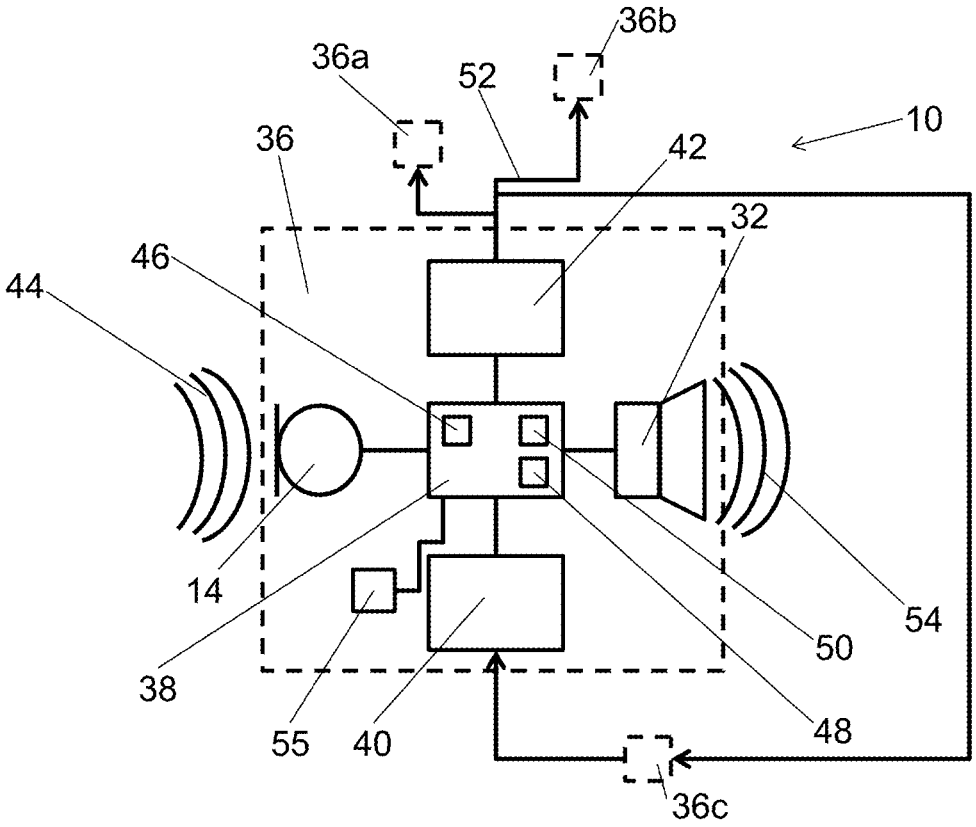
FIG. 2 shows a schematic illustration of a first embodiment of a communication system.

FIG. 2 shows a first embodiment of a communication system 10 according to the present disclosure, the system comprising or being formed by several communication devices 36, 36*a*, 36*b*, and 36*c*. Each of the communication devices 36 (36*a*, 36*b*, 36*c*) comprises a microphone 14, a control unit 38, a receiver unit 40, a transmitter unit 42 and an output transducer 32. The communication devices 36 can also alternatively comprise only some of the features or more features and/or can be connected to other features.

Input sound 44, e.g., a person's voice, music, noise, ambient sound or other sound, is recorded by the microphone 14, which generates an audio signal from the input sound 44. The audio signal is a digital signal or can be digitalised by an A/D converter (not shown, e.g. forming part of the microphone unit 14). The audio signal is transmitted to the control unit 38 where it can be processed by a processor 46. The processor 46 can for example amplify certain frequencies of the audio signal more than other frequencies, adjust the sound level of the audio signal, reduce acoustic feedback, reduce background noise, adjust different listening environments, transpose frequencies or process the audio signal in other ways (e.g. providing a level dependent compression). The control unit 38 further comprises a voice detector 48 which is configured to detect if a voice signal is present in the audio signal. Optionally the control unit 38 can be configured to limit transmission of the audio signal to the transmitter unit 42 when no voice signal is present in the audio signal. Alternatively, the control unit 38 can be configured to limit transmission of the audio signal to the transmitter unit 42 when a voice signal is present in the audio signal. A copy of the audio signal is saved in a memory 50 adapted to store audio and data signals for later use. The control unit 38 generates a data signal which comprises an identification of the communication device 36. The data signal can be modulated on (or otherwise included in, e.g. embedded in) the processed audio signal. The control unit 38 eventually transmits the processed audio signal and the data signal to the transmitter unit 42 from which it is transmitted via the audio and data link 52 to the other communication devices 36*a*, 36*b*, and 36*c*.

The receiver unit 40 of the communication device 36 receives an audio signal and data signal from the communication device 36*c*. The audio signal and data signal are transmitted from the receiver unit 40 to the control unit 38 of the communication device 36. The audio signal and data signal are processed by the processor 46 which identifies the origin of the audio signal and data signal by processing the data signal. If the data signal indicates a foreign (e.g. authorized, e.g. paired) communication device, e.g., communication device 36*c*, then the processor 46 processes the audio signal and transmits it to the output transducer 32. The output transducer 32, e.g., a loudspeaker (or electrodes of a cochlear implant, etc.), stimulates the hearing of a user, e.g., by generating sound waves 54.

The output transducer 32 can also be arranged in, e.g., in-the-canal hearing aid (ITC), completely-in-the-canal hearing aid (CIC) or at a hearing aid 28, e.g., behind-the-ear hearing aid (BTE), which is optionally attached to an attachable digital receiver 26. In this case the processor 46 is configured to process the audio signal by adding a hearing aid signal corresponding to (e.g. identifying) the users hearing aid 28 and providing the processed audio signal to the transmitter unit 42. The transmitter unit 42 transmits the processed audio signal via the audio and data link 52 to the hearing aid 28 or to the integrated or attachable digital receiver 26 attached to the hearing aid 28. In the hearing aid 28 the audio signal can be further processed (e.g. adapted to apply a level and frequency dependent gain according to a user's hearing impairment) or delivered to the output transducer 32 of the hearing aid 28 to stimulate the hearing of the hearing aid user according to the received audio signal.

The communication device 36 can comprise further units, e.g., a display, an interface, sensors, or other units or features. In this embodiment, the communication device comprises a vibration unit 55, which is configured to vibrate in response to a vibration signal generated by the control unit 38. The control unit 38 can for example be configured to generate a vibration signal if the connection to one of the communication devices 36*a*, 36*b*, 36*c* is low or lost, meaning that no data signal has been received by the receiver unit 40 for a certain amount of time indicating the foreign device or only a weak signal with data loss has been received.

Figure 3:
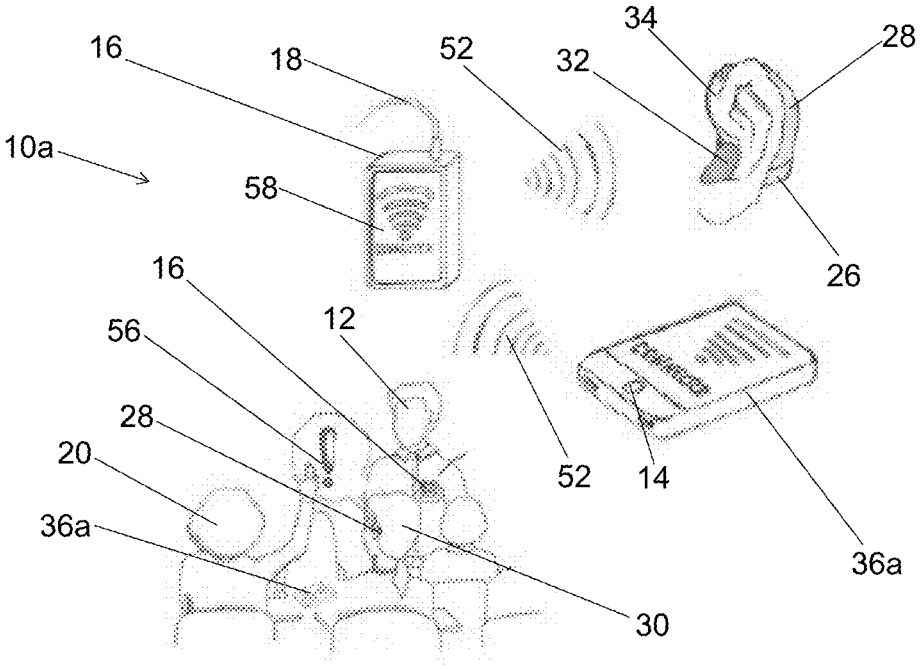
FIG. 3 shows a schematic illustration of a second embodiment of a communication system.

FIG. 3 shows a second embodiment of a communication system 10*a*, with a Smartphone 36*a* as a first communication device, a transmitter 16 as a second device, and an attachable digital receiver 26 attached to a hearing aid 28. The second device 16 can also be a Smartphone (see FIG. 4). In this embodiment the transmitter 16 is a master device worn by the teacher 12. The transmitter 16 is connected to a microphone (not shown) of the teacher 12 via the cable 18 (see FIG. 1). Alternatively, the microphone may be integrated with the transmitter (e.g. implemented by a microphone of the Smartphone).

Input sound is recorded by the microphone 14 of the Smartphone 36*a* of a student 20 (cf. FIG. 1). The Smartphone 36*a* transmits an audio signal generated from the input sound and a data signal to the transmitter 16 of the teacher 12 via the audio and data link 52. The transmitter 16 processes the audio signal and data signal by identifying the Smartphone 36*a*. Eventually the transmitter 16 transmits an audio signal and data signal to the attachable digital receiver 26 attached to the hearing aid 28 of the hearing impaired student 30 (see FIG. 1). The hearing aid 28 in this embodiment is a behind-the-ear (BTE) hearing aid 28. The audio signal is processed in the BTE hearing aid 28 and an output sound is generated by the speaker 32 in the ear 34 of the hearing impaired student 30.

The attachable digital receiver 26 comprises a vibration unit 55 (not shown), which is configured to indicate a low connectivity 56 with the audio and data link 52 by vibration. The vibration intensity is correlated with the connection status and has a higher intensity for lower connectivity. This may help the hearing impaired student to acknowledge the problem and to possibly inform the teacher. The connectivity status can also or alternatively be identified by a light signal, e.g., a light emitting diode, whereby the blinking frequency of the diode represents the quality of the connection. Further the transmitter 16 of the teacher comprises a vibration unit 55 (not shown), which is also configured to indicate the connectivity of the audio and data link 52 to the attachable digital receiver 26 or attachable digital receivers of hearing aid users 30 by vibration. Therefore the teacher receives an automated feedback if the connection of a hearing aid user 30 is lost or of low quality and can check the display 58 of the transmitter 16 to identify the attachable digital receiver 26 with low connectivity.

Figure 4:
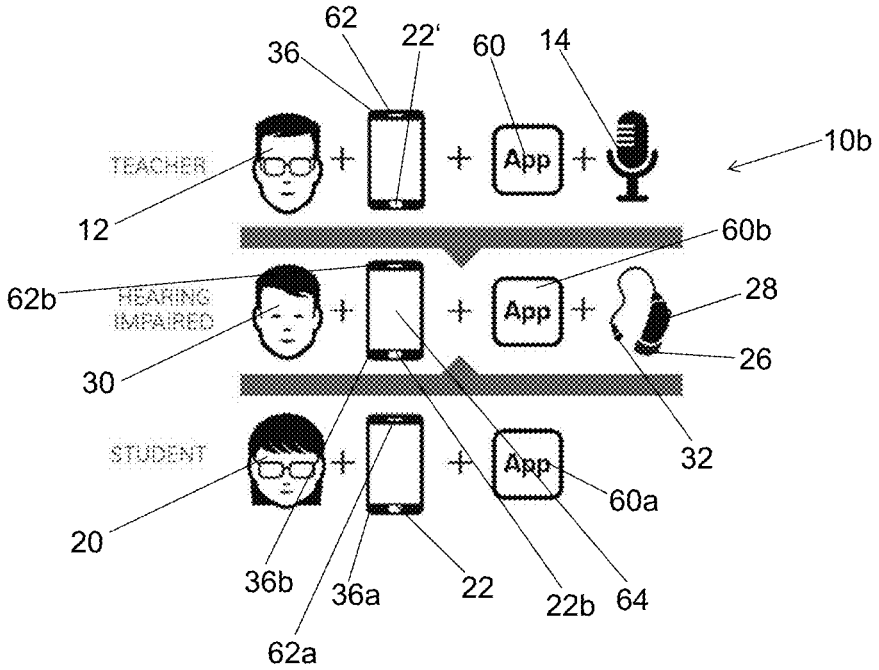
FIG. 4 shows a schematic illustration of a third embodiment of a communication system.

FIG. 4 shows a third embodiment of the communication system 10*b*. The communication system 10*b* comprises the Smartphones 36, 36*a*, and 36*b*, which are wirelessly connected to each other.

Each of the Smartphones runs a program application called "app" 60, 60*a*, and 60*b*. The apps 60, 60*a*, 60*b* are based on the same program but offer different functionalities to the users 12, 20, and 30.

The teacher Smartphone 36 runs a master app 60, which allows the control over the audio signal and data signal transmission to the other Smartphones 36*a*, 36*b*. Further the Smartphone 36 running the master app 60 can control which Smartphones are allowed to connect to the communication system 10*b*, respectively Smartphone network. In this embodiment, the Smartphone 36 hosts the communication system 10*b*. All student 20 and hearing impaired 30 user Smartphones 36*a*, 36*b* are connected to the teacher Smartphone 36 (e.g. via a wireless local area network, e.g. a standardized network, e.g. IEEE 802.11 (WiFi)). The communication system 10*b* can also be hosted in a Smartphone to Smartphone (peer-to-peer) network.

The Smartphone 36 determines a priority for the received audio signals and data signals and transmits only the signals with highest priority to the other Smartphones 36*a* and 36*b*. The priority is highest for the teacher 12 and can be set equal for the students 20 and hearing impaired 30 or the hearing impaired 30 can for example be assigned a higher priority. Additionally or alternatively, the priority can also be determined on a "first come first served" basis, where the first audio signal to be received by the teacher Smartphone 36 is transmitted to the other Smartphones 36*a* and 36*b*. Also, other priority schemes are possible, e.g., individual priority for each student or priority based on the discussion participation time. Instead of a teacher to student situation, it is also possible to use the communication system 10*b* in lecturer to student, moderator to talk-guest, politician to politician in political discussion, speaker to forum, or other communication situations, where one person hosts a discussion between a plurality of persons.

The teacher Smartphone 36 comprises a loudspeaker 62, which is configured to output sound generated from audio signals received by the teacher Smartphone 36. Alternatively or additionally, headphones can be connected to the Smartphone 36 for output of sound (not shown). The master app 60 is configured to wirelessly connect to an external microphone 14. A second microphone 22' is integrated in the Smartphone 36. The teacher 12 can decide whether he wants to use the integrated microphone 22', the external microphone 14 or both microphones 14 and 22' to record the teacher's voice. Use of both microphones 14 and 22' can e.g. be used to increase the directionality of the sound.

The Smartphone 36 displays the status of all connected students and has a vibration and/or light indication for low connection status of students (not shown).

The hearing impaired students' Smartphone 36*b* runs a hearing impaired app 60*b* which is configured to connect the Smartphone 36*b* with the hearing aid 28 via the attachable digital receiver 26. Audio signals received by the Smartphone 36*b* can be outputted by the output transducer 32, e.g., via electrodes of a cochlear implant or a loudspeaker of an air conduction hearing device, to the ear of the hearing impaired student 30, a loudspeaker 62*b*, or a headphone connected to the Smartphone 36*b* (not shown). The hearing impaired student 30 can use the microphone 22*b* of the Smartphone 36*b* to record sound or use the touch screen display 64 to type a text. The Smartphone 36*b* can also include a keyboard or it can be connected to a keyboard, e.g., via bluetooth, Wi-Fi, or other connection types (not shown). Especially mute students can benefit from the text input, which is processed into an audio signal on the hearing impaired student Smartphone 36*b* by the app 60*b* and transmitted to the teacher Smartphone 36. The text can also be transmitted to the teachers Smartphone 36 as a data signal and converted to an audio signal by the master app 60.

The student Smartphone 36*a* runs a student app 60*a*. The Smartphone 36*a* can connect to the teacher Smartphone 36 using the app 60*a*. The student app 60*a* is configured to transmit audio signals generated from recorded voice or sound from the microphone 22 to the teacher Smartphone 62 and data signals, e.g., for indicating the identity of the student 20 using the Smartphone 36*a*. The app 60*a* further allows the Smartphone 36*a* to receive audio signals and data signals from the teacher Smartphone 36. The audio signals can be outputted over a loudspeaker 62*a* or headphones connected to the Smartphone 36*a* (not shown).

All apps 60, 60*a*, 60*b* can be configured to enable the storing of audio signals and data signals for later use, e.g., preparation for exams, checking the participation level of students, or other uses. The data signals can for example also include video data, tables, documents, or the like which can be displayed on the Smartphone touch screen displays 64.

Distance learning students or ill at home students can connect to the teacher Smartphone 36 over the internet to participate in a course, class or lecture. A camera system (not shown) can be included in the communication system to monitor the lecture and transmit the video broadcast over the communication system. Alternatively or additionally a "Smartboard", which is to be understood as a virtual board that allows access via Wi-Fi and a touch screen display, can be connected to or form part of the communication system 10*b* (not shown). Data can be inserted to the Smartboard from the distance via Wi-Fi or in the class via the touch screen display.

Figure 5:
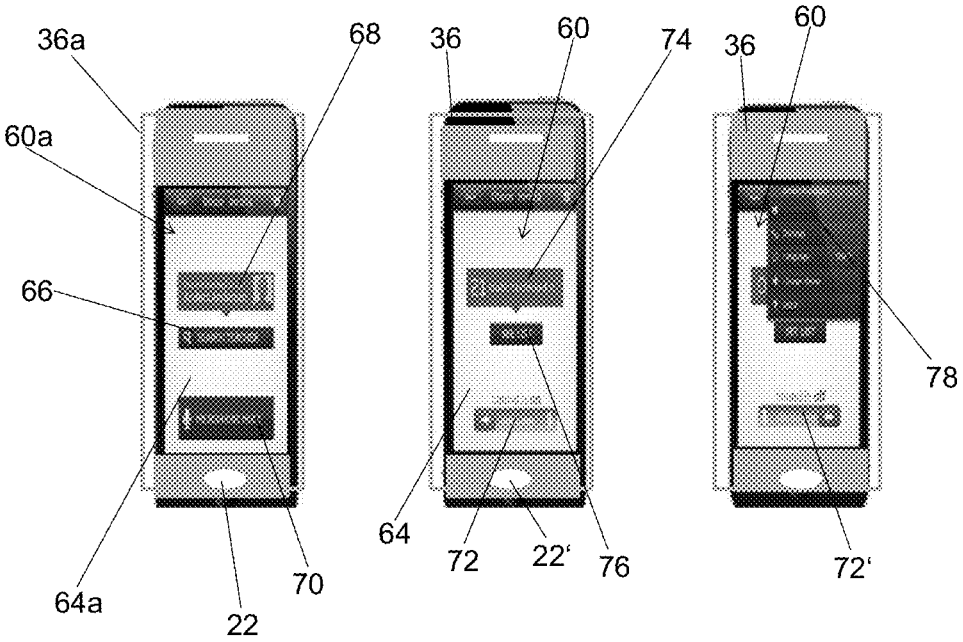
FIG. 5 shows a schematic illustration of an embodiment of an exemplary operating system of a communication system.

FIG. 5 shows an embodiment of an exemplary operating system (specifically illustrating a user interface), e.g., the apps 60*a* and 60 of a communication system 10*b* running on the Smartphone 36*a* and 36.

The app 60*a* runs on a Smartphone 36*a* (leftmost illustration in FIG. 5, e.g. for a normally hearing student) and displays several features on the touch screen display 64*a*. In this embodiment the touch screen display 64*a* shows the features searching a teacher 66, status messages 68, and mode selection 70. The feature of searching a teacher 66 allows to search a teacher network and to select the teacher network to connect to. The status message 68 displays the current network the Smartphone 36*a* is connected to. The app 60*a* allows to switch between a microphone mode 70, which allows to record sound using the microphone 22 and the status mode displayed on Smartphone 36*a* in FIG. 5.

The teacher Smartphone 36 (middle and rightmost illustrations in FIG. 5) runs the app 60, which has a sound slider 72 displayed on the touch screen display 64 to mute 72' or activate 72 the teacher microphone 14 (not shown) and/or the microphone 22'. The app 60 displays a status message 74 containing the number of student Smartphones 36*a* and 36*b* or other communication devices, e.g., tablets, PCs, or the like connected to the teacher Smartphone 36. The see list 76 button allows to list the Smartphones 36*a*, 36*b* and/or Students 20, 30 connected to the teacher Smartphone 36. A drop down menu 78 offers various features, e.g., changing the language, settings, theme, help, or other features, which can be activated by pushing on the virtual tab on the touch screen display 64.

Figure 6:
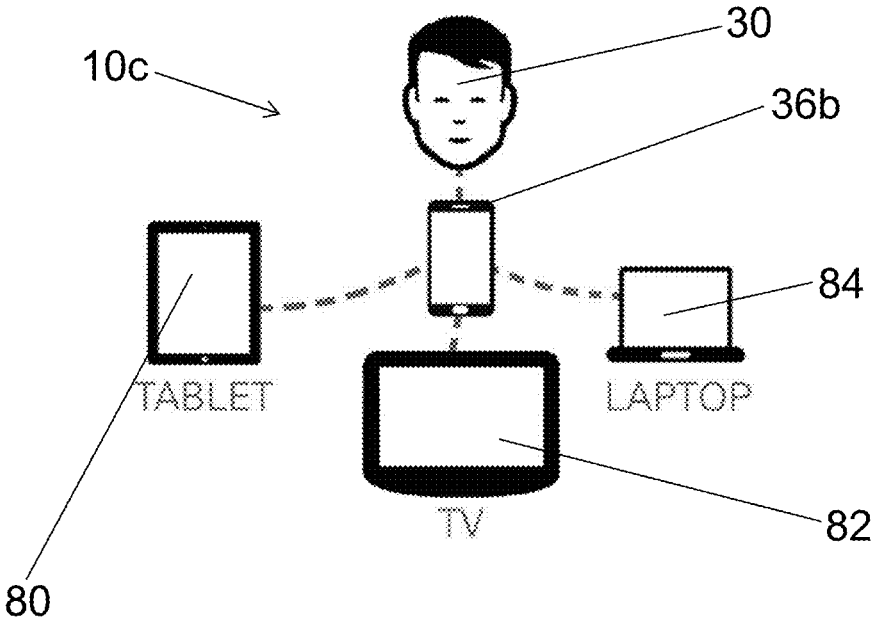
FIG. 6 shows a schematic illustration of a fourth embodiment of a communication system.

FIG. 6 shows a fourth embodiment of the communication system 10*c*. The hearing impaired student 30 uses the Smartphone 36*b* to wirelessly connect to a tablet 80, a television 82, and a laptop 84. The Smartphone 36*b* can also be connected to a Smartboard or any other electric device transmitting or receiving audio signals and/or video signals receivable or transmittable by the Smartphone 36*b*. In this embodiment the Smartphone 36*b* is wirelessly connected to the attachable digital receiver 26 of a hearing aid 28 (cf. e.g. FIG. 4) of the hearing impaired student 30, which receives audio signals from the Smartphone 36*b*. The attachable digital receiver 26 provides the audio signals to the hearing aid 28 worn by the hearing impaired student 30 (cf. e.g. FIG. 4), where the audio signals are processed and provided to the output transducer 32 (cf. e.g. FIG. 2, 3), which is a loudspeaker in this embodiment, but can also be electrodes of a cochlear implant or the like. The output transducer 32 stimulates the hearing of the hearing impaired student 30, allowing him to connect to the audio signals of various devices with the help of the Smartphone 36*b*. The Smartphone 36*b* can also comprise an output transducer 32, which stimulates the hearing of the hearing impaired student 30.

In one embodiment a method for using a communication system 10 comprises the step of establishing an audio and data link between communication devices. A next step of the method comprises receiving audio and data signals from communication devices. This step can be followed by a step of saving data from communication devices. A further step comprises determining which communication devices are connected with the communication system. The step can further comprise determining which communication device has priority. Another possible step comprises giving priority to the audio signal of the communication device which has priority. And a further step of the method comprises transmitting the audio signal to all communication devices. Preferably the step of the method comprises transmitting the audio signal with priority to all communication devices, which do not have priority. Some of the steps, e.g., saving data can be optional. Further steps are obvious regarding the communication system, e.g., generating a vibration signal in response to a low connection or lost connection and transmitting the vibration signal to a certain communication device or to a vibration unit of the device performing the method.

The present disclosure also regards the following items:

1. A communication system (10; 10*a*; 10*b*; 10*c*) comprising at least one communication device (36, 36*a*, 36*b*, 36*c*) configured to connect to other communication devices (36, 36*a*, 36*b*, 36*c*) via an audio and data link (52), wherein the communication device (36, 36*a*, 36*b*, 36*c*) comprises at least
   - a receiver unit (40) adapted to receive audio signals and data signals via the audio and data link (52),
   - an output transducer (32) adapted to stimulate the hearing of the user (12, 20, 30) according to the audio signals received via the audio and data link (52),
   - a microphone (22, 22') adapted to receive input sound (44) and generate an audio signal from the received input sound (44),
   - a transmitter unit (42) adapted to transmit audio signals and data signals via the audio and data link (52), and
   - a control unit (38) connected to the receiver unit (40), to the output transducer (32), to the microphone (22, 22'), and to the transmitter unit (42),
   - wherein the control unit (38) is adapted to control the signal transmission between the receiver unit (40), the output transducer (32), the microphone (22, 22'), and the transmitter unit (42), wherein the control unit (38) is adapted to generate a data signal corresponding to the communication device (36, 36*a*, 36*b*, 36*c*) for identifying the communication device (36, 36*a*, 36*b*, 36*c*), wherein the control unit (38) comprises a processor (46) which is adapted to process audio signals and data signals, wherein the communication device (36, 36*a*, 36*b*, 36*c*) is connectable to an integrated or attachable digital receiver (26) via the audio and data link (52), and wherein the attachable digital receiver (26) optionally has a shape that matches a shape of a hearing aid (28) in order to be attached to the hearing aid (28).

2. A communication system (10; 10*a*; 10*b*; 10*c*) according to item 1, wherein the output transducer (32) of at least one of the communication devices (36, 36*a*, 36*b*, 36*c*) is an output transducer (32) of a hearing aid (28).

3. A communication system (10; 10*a*; 10*b*; 10*c*) according to item 1, wherein at least one hearing aid (28), which is adapted to be worn by a user (30), is connected to the communication system (10; 10*a*; 10*b*; 10*c*) via the audio and data link (52) and wherein the hearing aid (28) comprises at least a receiver unit (40) adapted to receive audio signals via the audio and data link (52) and an output transducer (32) adapted to stimulate the hearing of a user (30) according to the audio signals received.

4. A communication system (10; 10*a*; 10*b*; 10*c*) according to item 1, wherein the attachable digital receiver (26) is connected to the communication system (10; 10*a*; 10*b*; 10*c*) via the audio and data link (52) when in use, wherein the attachable digital receiver (26) comprises a receiver unit (40) to receive audio signals via the audio and data link (52) and wherein the attachable digital receiver (26) is adapted to be attached to a hearing aid (28), which is adapted to be worn by a user (30) and which comprises at least an output transducer (32) which is adapted to stimulate the hearing of a user (30) according to the audio signals received by the receiver unit (40) of the attachable digital receiver (26).

5. A communication system (10; 10*a*; 10*b*; 10*c*) according to at least one of the items 1 to 4, wherein each device (36, 36*a*, 36*b*, 36*c*; 16) of the communication system (10; 10*a*; 10*b*; 10*c*) is mobile.

6. A communication system (10; 10*a*; 10*b*; 10*c*) according to at least one of the items 1 to 5, wherein one of the communication devices (36, 36*a*, 36*b*, 36*c*) of the communication system (10; 10*a*; 10*b*; 10*c*) is a master device (36) and all other communication devices (36, 36*a*, 36*b*, 36*c*) are slave devices (36*a*, 36*b*, 36*c*), wherein the master device (36) is configured to receive audio signals and data signals from the slave devices (36*a*, 36*b*, 36*c*) and transmit audio signals and data signals to the slave devices (36*a*, 36*b*, 36*c*), and wherein the slave devices (36*a*, 36*b*, 36*c*) are configured to receive audio signals and data signals only from the master device (36).

7. A communication system (10; 10*a*; 10*b*; 10*c*) according to at least one of the items 1 to 6, wherein the communication device (36, 36*a*, 36*b*, 36*c*) comprises a memory (50) and wherein the memory (50) is adapted to store audio signals and data signals.

8. A communication system (10; 10*a*; 10*b*; 10*c*) according to item 7, wherein at least one communication device (36, 36*a*, 36*b*, 36*c*) is a Smartphone (36, 36*a*, 36*b*, 36*c*), which further comprises a wireless interface to the public switched telephone network, an operating system and/or applications (60, 60*a*, 60*b*) running on the processor (46) of the communication device (36, 36*a*, 36*b*, 36*c*), a user interface (64, 64*a*), a wireless data interface, and/or sensors.

9. A communication system (10; 10*a*; 10*b*; 10*c*) according to at least one of the items 1 to 8, wherein at least one communication device (36, 36*a*, 36*b*, 36*c*) is connected to an external microphone (14), which is adapted to be worn by a user (12).

10. A communication system (10; 10*a*; 10*b*; 10*c*) according to at least one of the items 1 to 9, wherein the communication device (36, 36*a*, 36*b*, 36*c*) comprises a voice detector (48) adapted to determine if an audio signal comprises a voice signal, wherein the voice detector (48) is connected to the control unit (38), and wherein the control unit (38) is adapted to automatically transmit the audio signal, when a voice signal is detected in the audio signal by the voice detector (48).

11. A communication system (10; 10*a*; 10*b*; 10*c*) according to at least one of the items 1 to 10, wherein the audio and data link (52) is a digital link (52) which forms a wireless network.

12. A communication system (10; 10*a*; 10*b*; 10*c*) according to at least one of the items 1 to 11, wherein at least a communication device (36, 36*a*, 36*b*, 36*c*) of the communication system (10; 10*a*; 10*b*; 10*c*) is adapted to connect to other media (16; 80, 82, 84) initially not forming part of the communication system (10; 10*a*; 10*b*; 10*c*).

13. An attachable digital receiver (26) configured to connect a communication device (36, 36*a*, 36*b*, 36*c*) and a hearing aid (28), wherein the attachable digital receiver (26) comprises a receiver unit (40) configured to connect to at least one communication device (36, 36*a*, 36*b*, 36*c*) via an audio and data link (52) and to receive digital audio signals and digital data signals via the audio and data link (52) wirelessly, wherein the attachable digital receiver (26) has a shape that matches a shape of the hearing aid (28) in order to be attached to the hearing aid (28), and wherein the attachable digital receiver (26) comprises a transmitter unit (42) configured to connect to the hearing aid (28) and to transmit digital audio signals and digital data signals to the hearing aid (28).

14. Use of Smartphones (36, 36*a*, 36*b*, 36*c*) according to item 8 in a communication system (10; 10*a*; 10*b*; 10*c*) according to at least one of the items 1 to 12.

15. A method for operating a communication system (10; 10*a*; 10*b*; 10*c*), comprising the steps of:

establishing an audio and data link (52) between communication devices (36, 36*a*, 36*b*, 36*c*), receiving audio and data signals from communication devices (36, 36*a*, 36*b*, 36*c*), saving data from communication devices (36, 36*a*, 36*b*, 36*c*), determining which communication devices (36, 36*a*, 36*b*, 36*c*) are connected with the communication system (10; 10*a*; 10*b*; 10*c*) and which communication device (36, 36*a*, 36*b*, 36*c*) has priority, giving priority to the audio signal of the communication device (36, 36*a*, 36*b*, 36*c*) which has priority, transmitting the audio signal with priority to all communication devices (36, 36*a*, 36*b*, 36*c*), which do not have priority.

REFERENCE SIGNS

10 communication system
12 teacher
14 microphone
16 transmitter
18 cable
20 student

22 student microphone
24 audio link
26 attachable receiver
28 hearing aid
30 hearing impaired student
32 output transducer
34 ear
36 communication device
38 control unit
40 receiver unit
42 transmitter unit
44 input sound
46 processor
48 voice detector
50 memory
52 audio and data link
54 sound wave
55 vibration unit
56 low connectivity
58 display
60 app
62 speaker
64 touch screen display
66 searching a teacher
68 status message
70 mode selection
72 sound slider
74 status message
76 see list
78 drop down menu
80 tablet
82 television
84 laptop

The invention claimed is:

1. A communication system comprising: a master communication device; and a slave communication device, wherein said master communication device is configured to connect to said slave communication device via an audio and data link, wherein the master communication device is configured to:

receive audio signals and data signals from said slave device via the audio and data link, transmit audio signals and data signals to said slave device via the audio and data link, and control transmission of audio signals and data signals to said slave communication device, such that said master communication device functions as a host for the communications system, wherein said slave communication device is configured to:

receive audio and data signals from said master device and transmit such audio and data signals to a hearing aid, said hearing aid having a digital receiver configured to receive the audio and data signals from said slave communication device.

2. The communication system according to claim 1, wherein the digital receiver has a shape that matches a shape of a hearing aid in order to be attached to the hearing aid.

3. The communication system according to claim 1, wherein the digital receiver is integrated with theft hearing aid.

4. The communication system according to claim 1, wherein the hearing aid includes an output transducer.

5. The communication system according to claim 1, wherein the master communication device and the slave communication device of the communication system are mobile devices.

6. The communication system according claim 1, wherein the master communication device comprises a memory and wherein the memory is adapted to store audio signals and data signals.

7. The communication system according to claim 6, wherein the master communication device and the slave communication device are each a Smartphone.

8. The communication system according claim 1, wherein at least one of the master communication device and slave communication device is connected to an external microphone, which is adapted to be worn by a user.

9. The communication system according to claim 1, wherein the master communication is device is further configured to determine if an audio signal comprises a voice signal and to automatically transmit the audio signal, when a voice signal is detected in the audio signal.

10. The communication system according to claim 1, wherein the audio and data link is a digital link which forms a wireless network.

11. The communication system according to claim 1, wherein at least one of the master communication device and the slave communication device of the communication system is adapted to connect to other media initially not forming part of the communication system.

12. The communication system according to claim 1, wherein said communication system comprises multiple slave communication devices and said master communication device is configured to prioritize transmission of audio signals and data signals to at least one of said slave communication devices.

* * * * *